US006237678B1

(12) United States Patent
Yamada

(10) Patent No.: US 6,237,678 B1
(45) **Date of Patent: *May 29, 2001**

(54) HEAT EXCHANGER

(75) Inventor: Shinji Yamada, Tokyo (JP)

(73) Assignee: Calsonic Kansei Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/884,166

(22) Filed: Jun. 27, 1997

(30) Foreign Application Priority Data

Jun. 27, 1996 (JP) ..... 8-167457

(51) Int. Cl.[7] ..... F28F 1/02
(52) U.S. Cl. ..... 165/134.1; 165/177
(58) Field of Search ..... 165/152, 177, 165/183, 134.1

(56) References Cited

U.S. PATENT DOCUMENTS 4,119,144 10/1978 Kum .
4,332,293 * 6/1982 Hiramatsu ..... 165/153
4,570,700 * 2/1986 Ohara et al. ..... 165/134.1
4,998,580 3/1991 Guntly et al. .
5,295,302 3/1994 Takai et al. .

FOREIGN PATENT DOCUMENTS 2 133 525 7/1984 (GB) .
5-228620 9/1993 (JP) .

* cited by examiner

*Primary Examiner*—Allen Flanigan
(74) *Attorney, Agent, or Firm*—Foley & Lardner

(57) ABSTRACT

A flattened heat-transfer tube is formed by superimposing on each other a pair of plane portions provided at both ends of a plate of aluminum alloy are superimposed on each other to thereby form a joint. The joints are positioned on the downwind side, and folded portions having a U-shaped cross section are positioned on the windward side. Accordingly, there is a tendency to spread kinetic energy of foreign substances resulting from collision with the folded portions over their entirety, thereby preventing the application of high degree of stress to part of the flattened heat-transfer tubes, as well as contributing to improvements in the durability of the flattened heat-transfer tubes.

10 Claims, 4 Drawing Sheets

HEAT EXCHANGER

BACKGROUND OF THE INVENTION

1. Field of the Invention

A heat exchanger according to the present invention is to be utilized as a built-in condenser for an automobile air conditioner.

2. Description of the Prior Art

An automobile air conditioner has a built-in vapor compression refrigerator. In the vapor compression refrigerator, high-temperature coolant discharges from a compressor under high pressure passes through a condenser 1 illustrated in FIG. 2 and is condensed and liquefied. The condenser 1 as described in, e.g., Japanese Patent Publication No. Hei. 5-228620, is created by brazing members of aluminum alloy to each other in combination. First, a pair of cylindrical headers 2*a,* 2*b* closed at both ends are spaced a distance away from each other, and a plurality of flattened heat-transfer tubes 3, 3 are provided across and between the inner sides of the pair of headers 2*a,* 2*b* (i.e., between the side surfaces of the headers facing each other). These flattened heat-transfer tubes 3, 3 are spaced away from each other and are connected at one end to the header 2*a* and at the other end to the header 2*b*. Both ends of the flattened heat-transfer tubes 3, 3 are respectively brazed to the headers 2*a,* 2 *b,* so that the joints are air and fluid tight. Corrugated fins 4, 4 made by corrugating strip-shaped thin plates of aluminum alloys are sandwiched between the adjacent flattened heat-transfer tubes 3, 3, thereby constituting a core 5.

To condense and liquefy the high-temperature coolant discharged from the compressor under high pressure by means of the condenser 1 having the aforementioned structure, the coolant is fed into the header 2*a* from an inlet port (not shown) formed in part of the header 2*a*. During the course of flow through the plurality of flattened heat-transfer tubes 3, 3 from the header 2*a* to the header 2*b,* or during the course of travel between the headers 2*a,* 2*b* through the plurality of flattened heat-transfer tubes 3, 3 (where the headers 2*a,* 2*b* are respectively partitioned into small compartments), heat is exchanged between the heat-transfer tubes and a draft of air flowing from the front side to the rear side of the core 5, so that the coolant is condensed and liquefied.

A heat-transfer tube as illustrated in FIGS. 3 and 4 is used for part of the condenser 1 having the foregoing structure as one type of the flattened heat-transfer tubes 3, 3. This flattened heat-transfer tube 3 is made by the steps of folding one plate of aluminum alloy into an U-shaped form along its longitudinal center (which will become the folded portion 6); superimposing on each other plane portions 7, 7 formed at both ends of the aluminum alloy plate; and brazing the thus-superimposed plane portions 7, 7 to thereby form a joint 8. In order to effect efficient brazing of the plane portions 7, 7 as well as brazing of the flattened heat-transfer tubes 3, 3 with the corrugated fins 4, 4, there are used so-called clad materials in which brazing materials are formed on one side or both sides of a core material of the aluminum alloy plate. Further, in order to bond both ends of the flattened heat-transfer tubes 3, 3 in which the joints 8 (which extend from one longitudinal end of the flattened heat-transfer tubes 3, 3 in their cross sectional direction) to the headers 2*a,* 2*b* without clearance between them, through holes matched with the outer shapes of the flattened heat-transfer tubes 3, 3 are formed in the respective inner side surfaces of the headers 2*a,* 2*b*. A clearance between the outer circumferential surface of the ends of the respective flattened heat-transfer tubes 3, 3 and the inner circumferential edges of the through holes is filled with the brazing material which is laid on the surface of each of the flattened heat-transfer tubes 3, 3 and the aluminum alloy plate of the headers 2*a,* 2*b*. An inner fin 10 is provided in each of the flattened heat-transfer tubes 3, 3. This inner fin 10 contributes to improvements in this efficiency of heat exchange between a fluid circulating through each flattened heat-transfer tube 3 and the flattened heat-transfer tube 3, as well as to improvements in the resistance against the inner and outer pressure of each flattened heat-transfer tube 3, especially against the inner pressure produced inside of the flattened heat-transfer tube 3. Accordingly, the inner fin 10 and the inner circumferential surface of each flattened heat-transfer tube 3 are brazed together.

If the condenser 1 that includes the flattened heat-transfer tubes 3, 3 having the foregoing joints 8 is filled to an automobile, it is attached to the automobile while the joints 8 are positioned on the windward side (i.e., at a location on the left-hand side of FIG. 3). For example, FIG. 7 shows a whole view of an automobile in which the condenser 1 is installed at the front of the automobile. In FIG. 3, the draft of air flows from left to right as indicated by $\alpha$. In general, the joints 8 are directed in the direction in which the automobile is headed. The reason for this is that even if foreign substances, such as pebbles, hit the front of the core 5 during the travel of the automobile, the joints 8 will receive the foreign substances and in so doing protect the main body of each of the flattened heat-transfer tubes 3, 3.

However, a recent study conducted by the inventors of this patent showed that there is a risk of damage to the durability of each of flattened heat-transfer tubes 3, 3 if the joints 8 are positioned on the windward side. Specifically, in order to test the durability of the condenser 1 having the flattened heat-transfer tubes 3, 3 as illustrated in FIGS. 3 and 4, the inventors performed tests in which steel balls having substantially the same weight as that of foreign substances (which have a high risk of hitting the front edges of the flattened heat-transfer tubes 3, 3) were brought into collision with the joints 8 at various angles. As a result of this test, if steel balls 8 come into collision with the joints 8 from the front at an angle, it has turned out that comparatively large stresses act on the curved areas 9, 9 carried from the joint 8 according to moment stress exerted on the joints 8. The stress exerted on the curved areas 9, 9 elastically deforms the curved areas 9, 9, as well as causing residual stress in each of the curved areas 9, 9. For example, FIG. 5 is a side view of the flattened heat-transfer tube 3 in a state that the foreign substance such as a pebble hits the plane portion 7 in a downward direction, so that the plane portions 7, 7 are directed upwardly. In this case, the stress easily concentrate and remain at the portion B. Consequently, there is a risk of loss of the durability of each of the flattened heat-transfer tubes 3, 3. Further, mud or the like are easily gathered at the portion B, which causes corrosion.

SUMMARY OF THE INVENTION

The present invention has been conceived in view of the foregoing circumstances.

According to the present invention, there is provided a heat exchanger used for an air conditioner of an automobile, comprising a pair of first and second headers spaced a distance from each other; a plurality of flattened heat-transfer tubes which are spaced a distance from each other and are connected at a first end thereof to the first header and connected at a second end thereof to the second header, wherein each of the flattened heat-transfer tubes is made in such a manner that one metal plate is folded along a center thereof so as to have an U-shaped cross section, plane portions formed at both ends of the metal plate are superimposed and connected together so as to form a joint at superimposed plane portions; and a plurality of fins sandwiched between adjacent flattened heat-transfer tubes; wherein the joint is positioned on a downwind side during a travel of the automobile.

In the heat exchanger of the present invention having the foregoing structure, as a result of placing the joints (which are made by superimposing the plane portions on another) on the downwind side, the folded portions (which are made by folding the metal plates so as to have a U-shaped cross section along the middle of the metal plates) are positioned on the windward side.

If foreign substances, such as pebbles, come into collision with the folded portions associated with the travel of an automobile having the heat exchanger of the present invention at the front portion thereof, the impact stress exerted on the folded portions is dispersed, thereby resulting in a reduction of the risk of exerting high levels of stress on part of the flattened heat-exchange tubes. For this reason, the durability of the flattened heat-transfer tube can be ensured.

DETAILED DESCRIPTION OF THE PREFERRED EMBODIMENT

Figure 1:
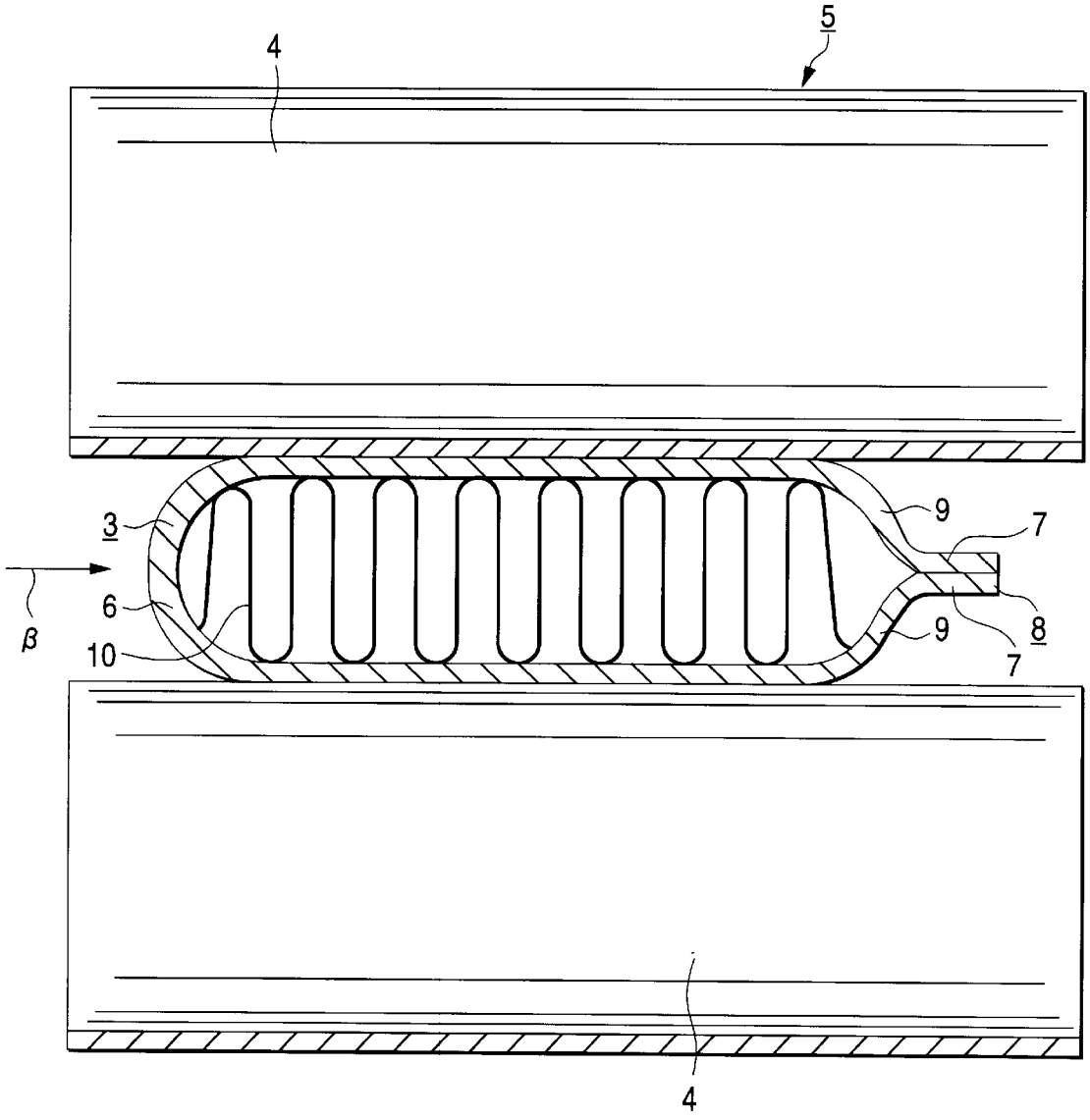
FIG. 1 is a view which illustrates one embodiment of the present invention and corresponds to an enlarged cross section of a condenser taken across line A—A in FIG. 2.
Figure 2:
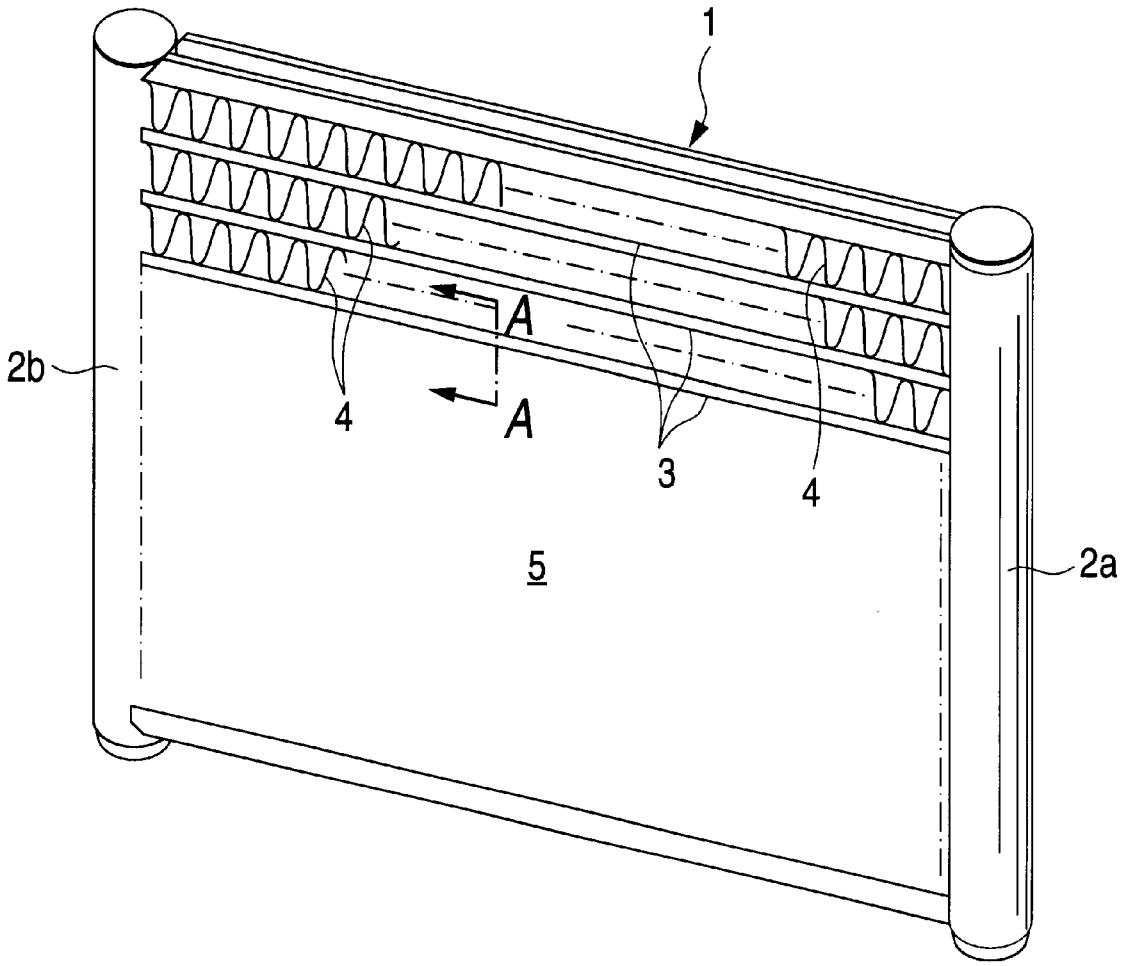
FIG. 2 is a substantially perspective view illustrating one example of a heat exchanger which is the object of the present invention.
Figure 3:
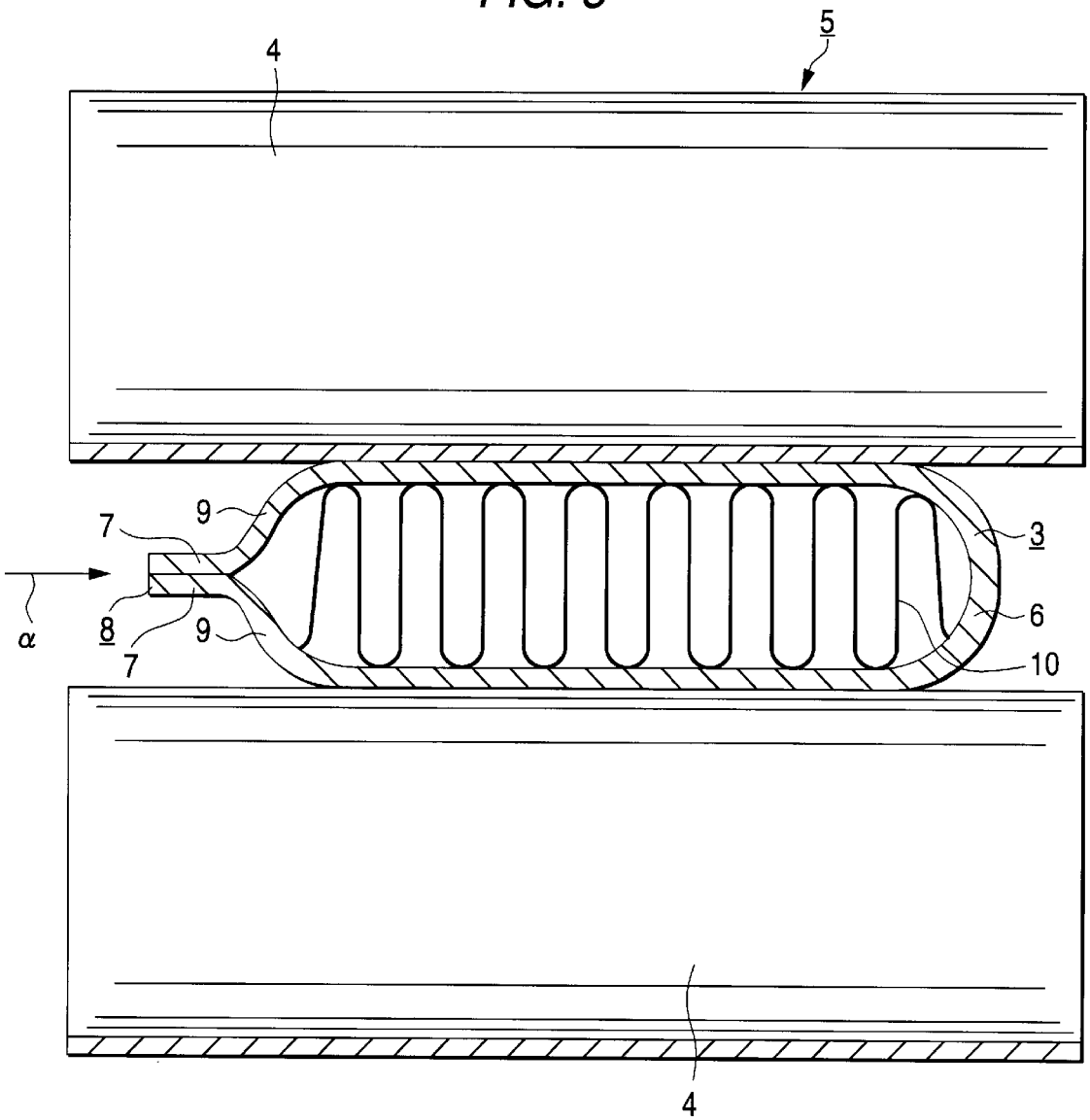
FIG. 3 is a view which illustrates the structure of a conventional heat exchanger and corresponds to the enlarged cross section taken across line A—A in FIG. 2.
Figure 4:
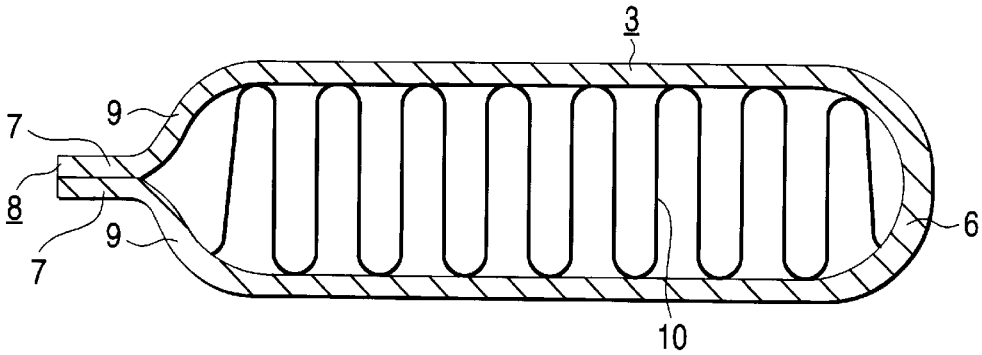
FIG. 4 is a cross section of only a flattened heat-transfer tube.
Figure 5:
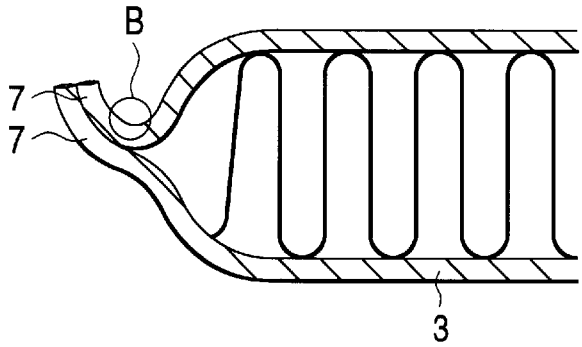
FIG. 5 is a side view of the flattened heat-transfer tube in a state that the foreign substance hits the plane portion in a downward direction.

FIG. 1 illustrates one embodiment of the present invention. For example, a heat exchanger of the present invention to be used as a condenser 1 has the same overall structure as that of the conventional heat exchanger shown in FIG. 2, and therefore its explanation will be omitted here for brevity. An explanation will be given principally to the features of the present invention. In the heat exchanger of the present invention, flattened heat-transfer tubes 3 form a core 5 of the condenser 1 together with fins 4, 4. A joint 8 is formed by superimposing on each other a pair of plane portions 7, 7 provided at one end of each flattened heat-transfer tube 3. The joints 8 are positioned on the downwind side (at a location on the right-hand side of FIG. 1). In FIG. 1, a draft of air flows from left to right as indicated by arrow β. Accordingly, a folded portion 6 (which is formed as a result of folding the flattened heat-transfer tube 3 of an aluminum alloy plate so as to have a U-shaped cross section along its middle) is positioned on the windward side.

Figure 6:
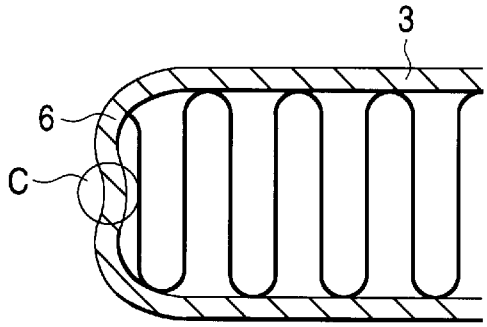
FIG. 6 is a side view of the flattened heat-transfer tube in a state that the foreign substance hits the folded portion.
Figure 7:
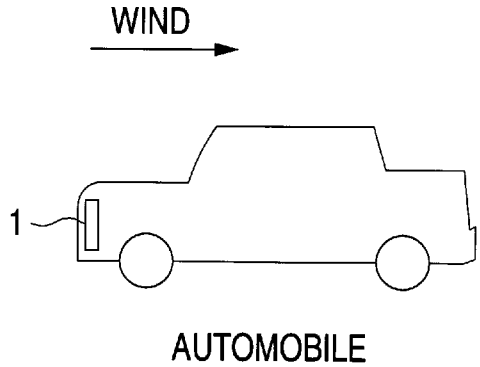
FIG. 7 is a whole view of an automobile in which the condenser is installed at the front thereof.

If foreign substances, such as pebbles, come into collision with the folded portions 6 associated with the travel of the automobile having the built-in condenser 1 which is the heat exchanger of the present invention, impact stress exerted on the folded portions 6 are dispersed, thereby resulting in a reduction of the risk of exerting high levels of stress on part of the flattened heat-exchange tubes. More specifically, the folded portion 6 are formed so as to have a U-shaped cross section containing a semicircular arc. Therefore, even if foreign substances come into collision with the folded portions from the front as well as from the front at an angle, there is a tendency to spread the impact energy over the entire folded portions 6, thereby resulting in a reduction in the risk of high levels of stress on part of the flattened heat-exchange tubes. For example, FIG. 6 is a side view of the flattened heat-transfer tube 3 in a state that the foreign substance such as a pebble hits the folded portion 6. In this case, it is the case that that the stress does not concentrate and remain at the portion C. Accordingly, the durability of the plurality of flattened heat-exchange pipes 3 that form the core 5 can be ensured.

Since the heat exchanger of the present invention has the foregoing structure and operates in the manner as previously described, the risk of developing high degrees of residual stress in the flattened heat-transfer tubes is reduced, resulting in improvements in the reliability and durability of the heat exchanger having the flattened heat-transfer tubes incorporated therein.

What is claimed is:

1. A method of positioning a condenser in an automobile having a front end and a rear end, comprising the steps of:

providing said condenser, wherein said condenser comprises:

a pair of first and second headers spaced a distance from each other, a plurality of flattened heat-transfer tubes which are spaced a distance from each other and are connected at a first end thereof to said first header and connected at a second end thereof to said second header, wherein each of said flattened heat-transfer tubes is made in such a manner that one metal plate is folded along a center thereof so as to have a U-shaped cross section, and plane portions formed at both ends of said metal plate are superimposed and connected together so as to form a joint at superimposed plane portions, each of said plurality of heat-transfer tubes having a first width, and a plurality of fins sandwiched between adjacent flattened heat-transfer tubes, each of said plurality of fins having a second width larger than said first width of said heat-transfer tubes; and mounting said condenser at the front end of the automobile in a position that receives stress deforming foreign substances such that said joint is directed toward the rear end of the automobile to increase the durability of said condenser, wherein a thickness of said metal plate used in forming each of said plurality of heat-transfer tubes is substantially constant.

2. The method of claim 1, wherein each of said flattened heat-transfer tubes comprises an undulating inner fin brazed to an inner circumferential surface of said heat-transfer tube.

3. An automobile comprising:

a front end configured to house an air conditioner;

a rear end; and a condenser used for the air conditioner of the automobile, said condenser comprising:

a pair of first and second headers spaced a distance from each other, a plurality of heat-transfer tubes which are spaced a distance from each other and extending between said pair of first and second headers, wherein each of said heat-transfer tubes is formed by folding a metal plate along a center thereof to form a U-shaped portion along one length side of said heat-transfer tube, and ends of said metal plate are superimposed and connected together to form a joint of superimposed plane portions at another length side of said heat-transfer tube, each of said plurality of heat-transfer tubes having a first width, and at least one fin between adjacent heat-transfer tubes, said fin having a second width larger than said first width of said heat-transfer tubes, wherein said condenser is mounted at the front end of the automobile in a position that receives stress deforming foreign substances and such that said joint faces in a direction toward the rear end of the automobile and said U-shaped portion faces in a direction toward the front end of the automobile to increase the durability of said condenser, wherein a thickness of said metal plate used in forming each of said plurality of heat-transfer tubes is substantially constant.

4. The automobile of claim 3, wherein said heat-transfer tube of said heat exchanger further comprises an undulating inner fin brazed to an inner circumferential surface of said heat-transfer tube.

5. The method of claim 1, wherein said pair of first and second headers are positioned in a vertical direction, wherein each of said plurality of heat-transfer tubes extends in a horizontal direction between said pair of first and second headers, and wherein said joint of each of said plurality of heat-transfer tubes extends in a horizontal direction.

6. The automobile of claim 3, wherein said pair of first and second headers are positioned in a vertical direction, wherein each of said plurality of heat-transfer tubes extends in a horizontal direction between said pair of first and second headers, and wherein said joint of each of said plurality of heat-transfer tubes extends in a horizontal direction.

7. A method of positioning a condenser in an automobile having a front end and a rear end, comprising the steps of:

providing said condenser, wherein said condenser comprises:

a pair of first and second headers spaces a distance from each other, a plurality of flattened heat-transfer tubes which are spaced a distance from each other and are connected at a first end thereof to said first header and connected at a second end thereof to said second header, wherein each of said flattened heat-transfer tubes is made in such a manner that one metal plate is folded along a center thereof so as to have a U-shaped cross section, and plane portions formed at both ends of said metal plate are superimposed and connected together so as to form a joint at superimposed plane portions, and a plurality of fins sandwiched between adjacent flattened heat-transfer tubes; and mounting said condenser at the front end of the automobile in a position that receives stress deforming foreign substances such that said joint is directed toward the rear end of the automobile to increase the durability of said condenser, wherein a thickness of said metal plate used in forming each of said plurality of heat-transfer tubes is substantially constant.

8. A method of positioning a condenser in an automobile having a front end and a rear end, comprising the steps of:

providing said condenser, wherein said condenser comprises:

a pair of first and second headers spaced a distance from each other, a plurality of flattened heat-transfer tubes which are spaced a distance from each other and are connected at a first end thereof to said first header and connected at a second end thereof to said second header, wherein each of said flattened heat-transfer tubes is made in such a manner that one metal plate is folded along a center thereof so as to have a U-shaped cross section, and plane portions formed at both ends of said metal plate are superimposed and connected together so as to form a joint at superimposed plane portions, and a plurality of fins sandwiched between adjacent flattened heat-transfer tubes; and mounting said condenser at the front end of the automobile in a position that receives stress deforming foreign substances such that said joint is directed toward the rear end of the automobile to increase the durability of said condenser, wherein said pair of first and second headers are positioned in a vertical direction, wherein each of said plurality of heat-transfer tubes extends in a horizontal direction between said pair of first and second headers, and wherein said joint of each of said plurality of heat-transfer tubes extends in a horizontal direction, wherein a thickness of said metal plate used in forming each of said plurality of heat-transfer tubes is substantially constant.

9. An automobile, comprising:

a front end configured to house an air conditioner;

a rear end; and a condenser used for the air conditioner of the automobile, said condenser comprising:

a pair of first and second headers spaced a distance from each other, a plurality of heat-transfer tubes which are spaced a distance from each other and extending between said pair of first and second headers, wherein each of said heat-transfer tubes is formed by folding a metal plate along a center thereof to form a U-shaped portion along one length side of said heat-transfer tube, and ends of said metal plate are superimposed and connected together to form a joint of superimposed plane portions at another length side of said heat-transfer tube, and at least one fin between adjacent heat-transfer tubes, wherein said condenser is mounted at the front end of the automobile in a position that receives stress deforming foreign substances and such that said joint faces in a direction toward the rear end of the automobile and said U-shaped portion faces in a direction toward the front end of the automobile to increase the durability of said condenser, and wherein a thickness of said metal plate used in forming each of said plurality of heat-transfer tubes is substantially constant.

10. An automobile, comprising:

a front end configured to house an air conditioner;

a rear end; and a condenser used for the air conditioner of the automobile, said condenser comprising:

a pair of first and second headers spaced a distance from each other, a plurality of heat-transfer tubes which are spaced a distance from each other and extending between said pair of first and second headers, wherein each of said heat-transfer tubes is formed by folding a metal plate along a center thereof to form a U-shaped portion along one length side of said heat-transfer tube, and ends of said metal plate are superimposed and connected together to form a joint of superimposed plane portions at another length side of said heat-transfer tube, and at least one fin between adjacent heat-transfer tubes, wherein said condenser is mounted at the front end of the automobile in a position that receives stress deforming foreign substances and such that said joint faces in a direction toward the rear end of the automobile and said U-shaped portion faces in a direction toward the front end of the automobile to increase the durability of said condenser, wherein said pair of first and second headers are positioned in a vertical direction, wherein each of said plurality of heat-transfer tubes extends in a horizontal direction between said pair of first and second headers, and wherein said joint of each of said plurality of heat-transfer tubes extends in a horizontal direction, wherein a thickness of said metal plate used in forming each of said plurality of heat-transfer tubes is substantially constant.

* * * * *